US006419770B1

(12) United States Patent
Miyashita et al.

(10) Patent No.: US 6,419,770 B1
(45) Date of Patent: Jul. 16, 2002

(54) COLD-WARM WORKING AND HEAT TREATMENT METHOD OF HIGH CARBON-HIGH ALLOY GROUP STEEL

(75) Inventors: Shu Miyashita, Anjo; Masami Tanaka, Okazaki; Saburo Sugiura, Nagoya; Yoshitaka Nishizawa, Sendai, all of (JP)

(73) Assignee: DENSO Corporation, Kariya (JP)

( * ) Notice: Subject to any disclaimer, the term of this patent is extended or adjusted under 35 U.S.C. 154(b) by 0 days.

(21) Appl. No.: 09/541,058

(22) Filed: Mar. 31, 2000

(30) Foreign Application Priority Data

Apr. 1, 1999 (JP) ..... 11-095437
Feb. 22, 2000 (JP) ..... 2000-044097

(51) Int. Cl.[7] ..... C21D 7/02; C21D 8/00
(52) U.S. Cl. ..... 148/610; 148/609; 148/621
(58) Field of Search ..... 148/609, 610, 148/621

(56) References Cited

U.S. PATENT DOCUMENTS 3,976,482 A * 8/1976 Larson ..... 419/23
4,302,256 A * 11/1981 Kenton ..... 148/622
4,697,320 A * 10/1987 Ishihara et al. ..... 29/132
4,844,863 A * 7/1989 Miyasaka et al. ..... 419/8

FOREIGN PATENT DOCUMENTS

JP 62027553 A * 2/1987 ..... C21D/5/00
JP 62-070531 A * 4/1987 ..... C22C/1/04

* cited by examiner

*Primary Examiner*—Roy King
*Assistant Examiner*—Harry D. Wilkins, III
(74) *Attorney, Agent, or Firm*—Harness, Dickey & Pierce, PLC

(57) ABSTRACT

The high carbon stainless steel containing more than 0.5 mass % carbon and more than 8 mass % chromium, or the tool steel containing more than 0.5 mass % carbon and more than 0.5 mass % at least one of carbide producing metal elements including chromium, molybdenum, tungsten, vanadium, niobium and titanium is processed by cold-warm working such as forging at a temperature of less than 800 ° C. to make more than 10% plastic deformation to an extent that cracks and voids are formed in the crystallized first stage carbide and, further, processed by a Hot Isostatic Pressing treatment so that the cracks and voids may be cured.

3 Claims, 11 Drawing Sheets

50 μm

10 μm

COLD-WARM WORKING AND HEAT TREATMENT METHOD OF HIGH CARBON-HIGH ALLOY GROUP STEEL

CROSS REFERENCE TO RELATED APPLICATIONS

This application is based upon and claims the benefit of priority of Japanese Patent Applications No. H.11-95437 filed on Apr. 1, 1999 and No. 2000–44097 filed on Feb. 2, 2000, the contents of which are incorporated herein by reference.

BACKGROUND OF THE INVENTION

1. Field of the Invention:

The present invention relates to a cold-warm working and heat treatment method of high carbon-high alloy group steel, in particular, a Hot Isostatic Pressing treatment at high temperature and at high pressure to be executed after cold-warm forging process of high carbon-high alloy group steel so that cracks and voids of first stage carbide formed by the cold-warm forging may be effectively cured, thus, effectively preventing a reduction of machinery strength and a deterioration of sliding wear resistance due to the cracks and voids of the first stage carbide.

2. Description of Related Art:

Parts and components made of high carbon-high alloy group steel and applicable to, for example, machinery parts, automobile parts and so on, have been manufactured in a manner that column or square pillar shaped base elements are processed, after hot forming or machining working, through annealing, hardening and tempering treatment. If the parts and components made of high carbon-high alloy group steel are processed through cold working such as cold forging which is commonly applied to mass-produced parts and components, plenty of hard and large grain first stage carbides are crystallized so that not only the working die may wear out but also the parts and components thus processed are likely to be cracked due to the cracks and voids of the first stage carbide that are inevitably formed. Therefore, it has been considered difficult to apply the cold working such as cold forging to the parts and components mentioned above.

However, recently, owing to the development of die wear resistant steel or lubricant or the supply of parts and components having good dimensional accuracy and soft material characteristic, some of the parts and components are manufactured by the cold-warm forging at less than 600° C. temperature. But, as it is difficult to completely prevent the formation of cracks and voids of the first stage carbide, the cold-warm forging process mentioned above is implemented only on the parts and components applicable to a limited area where the deterioration of machinery characteristic is acknowledged to be allowable and the existance of the cracks and voids of the carbide is not so risky.

Further, keeping step with necessity of high pressure fuel supply system for vehicles and high speed working machinery, there is a recent tendency that highly rigid parts and components are strongly demanded and, if possible, such parts and components are fabricated by cold-warm forging in view of cost reduction.

SUMMARY OF THE INVENTION

The present invention has been made to solve potential problems in view of the above mentioned demand, and an object of the present invention is to provide a cold-warm working and heat treatment method of high carbon-high alloy group steel having a characteristic that, when a component made of high carbon stainless steel or high carbon-high alloy group steel is fabricated by cold-warm working such as forging with an aim of higher productivity and lower cost, cracks and voids of first stage carbide formed by the cold-warm forging may be effectively cured. As a result, with respect to the component so processed, a drawback such as a stick of full hard carbide to the sliding portions thereof may be solved, while the air tightness may be assured and the machinery characteristic may be improved.

To achieve the above object, the method comprises the steps of executing cold-warm working at a temperature of less than 800° C. to make more than 10% plastic deformation with respect to a component having plenty of crystallized first stage carbides and made of at least one kind of steel of high carbon-high alloy steel group including high carbon stainless steel and tool steel so that cracks and voids may be formed in the crystallized first stage carbide and executing a Hot Isostatic Pressing treatment on the component so that the cracks and voids in the first stage carbide may be cured.

The high carbon stainless steel contains more than 0.5 mass % carbon and more than 8 mass % chromium, and the tool steel contains more than 0.5 mass % carbon and more than 0.5 mass % at least one of carbide producing metal elements including chromium, molybdenum, tungsten, vanadium, niobium and titanium.

It is more preferable to execute the cold-warm working with respect to the component made of the steel mentioned above in a manner that the first stage carbide so crystallized are crushed in more fine size grain carbide, while cracks and voids are formed in the component, and, then, to execute the Hot Isostatic Pressing treatment on the component so that the cracks and voids formed in the component may be filled up with base material of the component. As a result, an impact strength of the component after the Hot Isostatic Pressing treatment becomes stronger than that before the hot-warm working because of change of the first stage carbide into more fine size grain carbide in the component.

As conditions of the Hot Isostatic Pressing treatment, preferably, the component is processed at a temperature of more than 900° C., with a pressure of more than 88.2 Mpa and during more than 0.5 soaking hours in an inert gas.

Further, it is preferable to carry out a hardening treatment of the component, after the Hot Isostatic Pressing treatment for curing the cracks of first stage carbide, by adequately adjusting cooling speed of the component.

BRIEF DESCRIPTION OF THE DRAWINGS

Other features and advantages of the present invention will be appreciated, as well as methods of operation and the function of the related parts, from a study of the following detailed description, the appended claims, and the drawings, all of which form apart of this application. In the drawings:

DETAILED DESCRIPTION OF THE PREFERRED EMBODIMENTS

Figure 1:
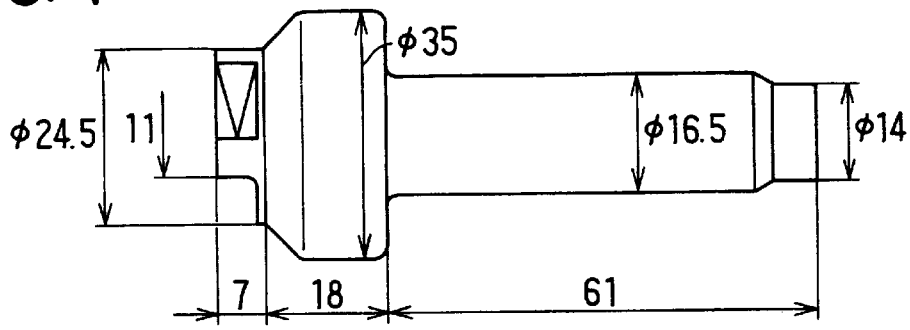
FIG. 1 is a view showing dimension and shape of a cold forging component according to an embodiment of the present invention.

Steel material subject to the present invention is any kind of steel in which plenty of hard and large grain first stage carbides are crystallized and, when the steel is processed by commonly used cold forging, formation of cracks and voids of the first stage carbide is inevitable. That is, the steel is one kind of steel of high carbon-high alloy steel group such as high carbon stainless steel and tool steel.

The high carbon stainless steel contains more than 0.5 mass % carbon and more than 8 mass % chromium, and the tool steel contains more than 0.5 mass % carbon and more than 0.5 mass % at least one of carbide producing metal elements including chromium, molybdenum, tungsten, vanadium, niobium and titanium.

Typical examples of the high carbon stainless steel are SUS 440A, SUS 440B and SUS 440C and those of the tool steel are SKD 11, SKD 12, SKH 2, SKH 51 and SKH 59.

As mentioned above, when a component made of the high carbon-high alloy group steel such as SKD 11 is processed by cold forging to make more than 10% plastic deformation, it has been considered inevitable that more than 20 $\mu$m cracks of the first stage carbide and voids on both sides of the first stage carbide were formed. However, as a result of experimental tests described later, it is concluded that a Hot Isostatic Pressing treatment (hereinafter called HIP treatment) under conditions mentioned below is very effective to cure the cracks and voids formed by the cold-warm forging.

The conditions of the HIP treatment are summarized below.

Atmospheric gas (pressure intermediate gas): an inert gas

Since the high carbon-high alloy group steel has a remarkably poor high temperature oxidization resistance so that the component made of the steel is likely to decarbonize and scales are likely to form on the surface thereof, it is preferable to execute the heat treatment in an inert gas such as argon gas.

Temperature: more than 900° C.

A flow stress of the high carbon-high alloy group steel becomes very low at more than 900° C. temperature, that is above an $\alpha$ to $\gamma$ transformation point, so that the deformability thereof may be high. If the heating temperature is less than 900° C., the flow stress of the steel becomes high and a relative pressure becomes low so that the steel may be unlikely to deform. Therefore, the HIP treatment temperature is preferably more than 900 ° C.

Applied pressure: more than 88.2 Mpa (900 kgf/cm$^2$)

It is well known that compression flow stress value of the high carbon-high alloy group steel such as, for example, SKD 11 is changeable according to a variation of deformation speed, as shown in Table 1. Therefore, if the worked component made of SKD 11 having the cracks and voids of the first stage carbide is processed by the HIP treatment, in which the deformation speed is remarkably slow (for example, $6\times10^{-3}$ mm/sec), with pressure of more than 88.2 Mpa (900 kgf/cm$^2$) at temperature 900° C. (more than 34.7 Mpa at temperature 1100° C.), it may be theoretically proved that the cracks and voids are compressed so as. to completely disappear.

Under the reason mentioned above, it is preferable that the HIP treatment is executed with pressure of more than 88.2 Mpa (900 kgf/cm$^2$).

Though there is no upper limit of the applied pressure, the pressure of 117.6 Mpa (1200 kgf/cm$^2$) is preferably the upper limit in view of the effectiveness of the equipment.

TABLE 1

| compression deformation speed | flow stress (Mpa) | | | |
|---|---|---|---|---|
| (mm/sec) | 900° C. | 1000° C. | 1100° C. | 1200° C. |
| 700 (hammer) | 245 | 245 | 215 | 147 |
| 6 (press) | 98.0 | 58.8 | 53.9 | 39.2 |
| $6\times10^{-3}$ (compression test machine) | 88.2 | — | 34.7 | — |

Treatment time: More than 0.5 hours

Figure 2:
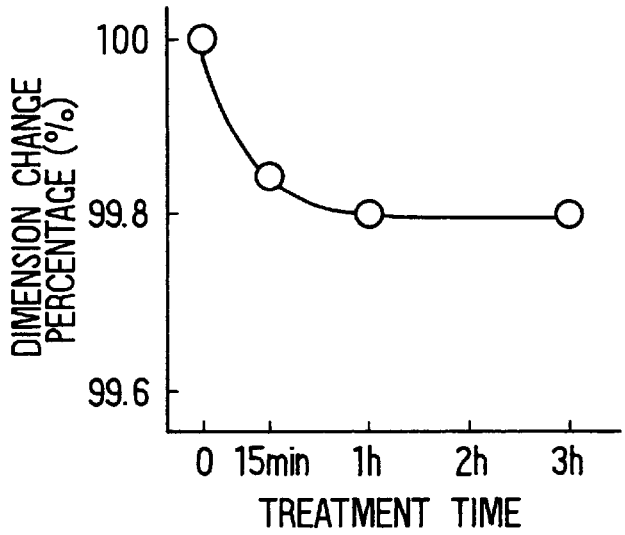
FIG. 2 is a graph showing a relationship between process time and dimensional change percentage on executing HIP treatment with respect to the component having cracks and voids of first stage carbide.

It is theoretically indicative that the HIP treatment may be sufficiently processed only during short period of times at the predetermined temperature and with the predetermined pressure. As a result of the experimental test described later, a dimensional change of the test piece almost saturates after a lapse of 15 minutes soaking treatment, as shown in FIG. 2. Therefore, the treatment time at high temperature and with high pressure is preferably 0.5 hours from a practical standpoint.

The HIP treatment conditions mentioned above are applicable not only to SKD 11 but also to any kind of steel of the high carbon-high alloy group steel.

Next, experimental test results are described hereinafter.

After steel of high carbon-high alloy group (SKD 11) having content compositions shown in Table 2 is worked through ingot formation process in an electric furnace, forging process, rolling process and annealing process at temperature of 850 to 870 ° C. so as to have hardness of HRB 90 to 93, unfavorable surface layers such as decarbonized layers are removed by machining. Then, test samples each having a diameter of 24 mm are prepared.

TABLE 2

| | (mass %) | | | | | | | | |
|---|---|---|---|---|---|---|---|---|---|
| | C | Si | Mn | P | S | Ni | Cr | Mo | V |
| SKD 11 | 1.47 | 0.27 | 0.42 | 0.005 | 0.004 | 0.11 | 11.49 | 0.91 | 0.32 |

Then, after cutting the test samples into small pieces, each of the test pieces is worked by 50% extruding cold forging and 50% upsetting cold forging to be formed in a shape shown in FIG. 1. For this purpose, a 400-ton transfer press is facilitated with an extruding die at a first stage thereof and an upsetting die at a second stage thereof. The test pieces are processed by oxalate bonderizing treatment and lubricant (molybdenum disulfide) coating treatment for protecting working surfaces of the die and preventing seizing and galling of surfaces of the working test pieces. The extruding cold forging with 50% working ratio and the upsetting cold forging with 50% working ratio are continuously executed in order. The treated pieces thus worked show very good finished appearances with allowable dimensional accuracy and without flaws and cracks on the surfaces thereof.

Figure 4A:
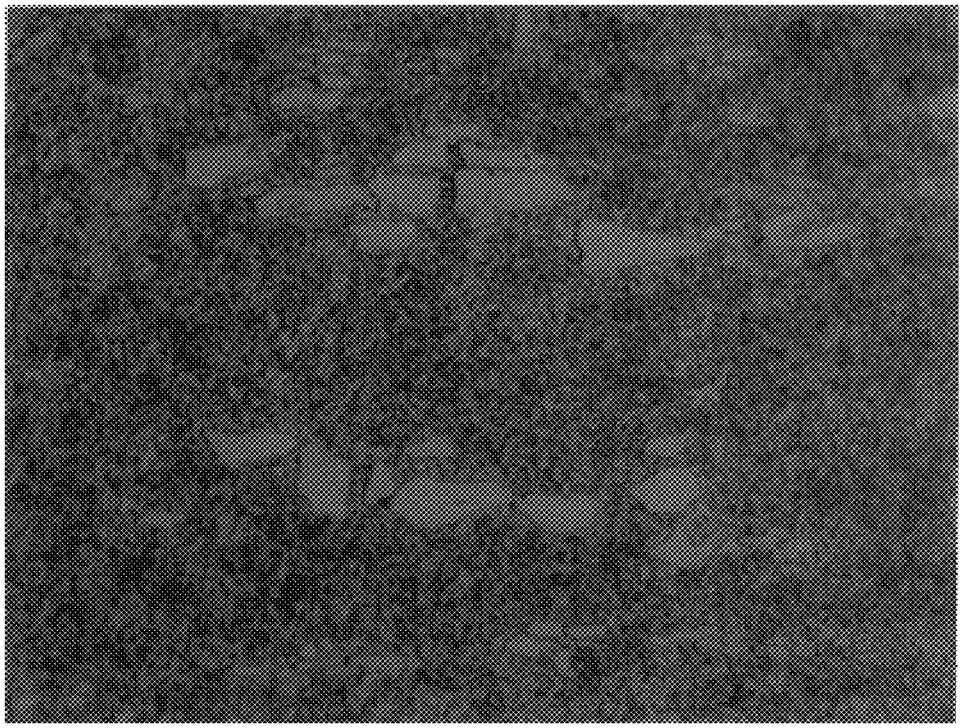
FIG. 4A is a photomicrograph showing a micro internal composition of a component before cold forging.
Figure 5A:
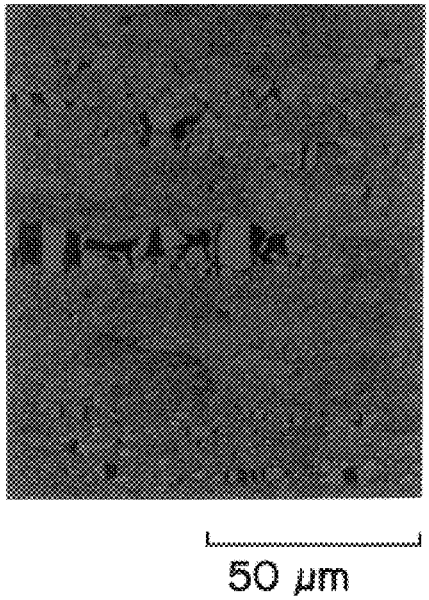
FIG. 5A is a photomicrograph showing a micro internal composition of a component extruded by cold forging.
Figure 5B:
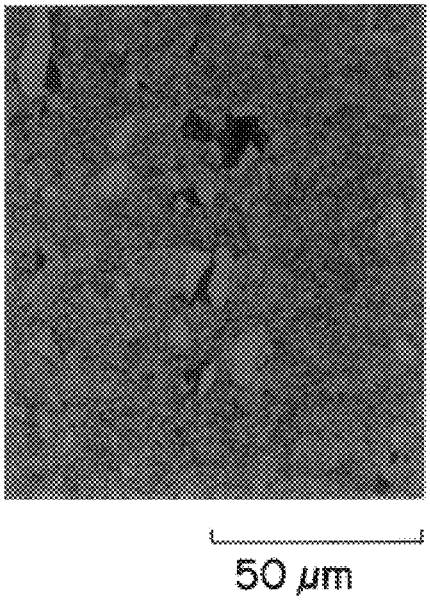
FIG. 5B is a photomicrograph showing a micro internal composition of a component upset by cold forging.

On the other hand, cracks of first stage carbide and voids on both sides of the first stage carbide are formed in internal compositions of both extruded and upset portions of the test pieces whose micro compositions are shown in FIGS. 5A and 5B, respectively. Compared with the composition of the test piece before cold forging process, as shown in FIG. 4A, formation of the cracks and voids is more remarkable to an extent that the components may not be used as machinery components without curing such cracks and voids.

Figure 4B:
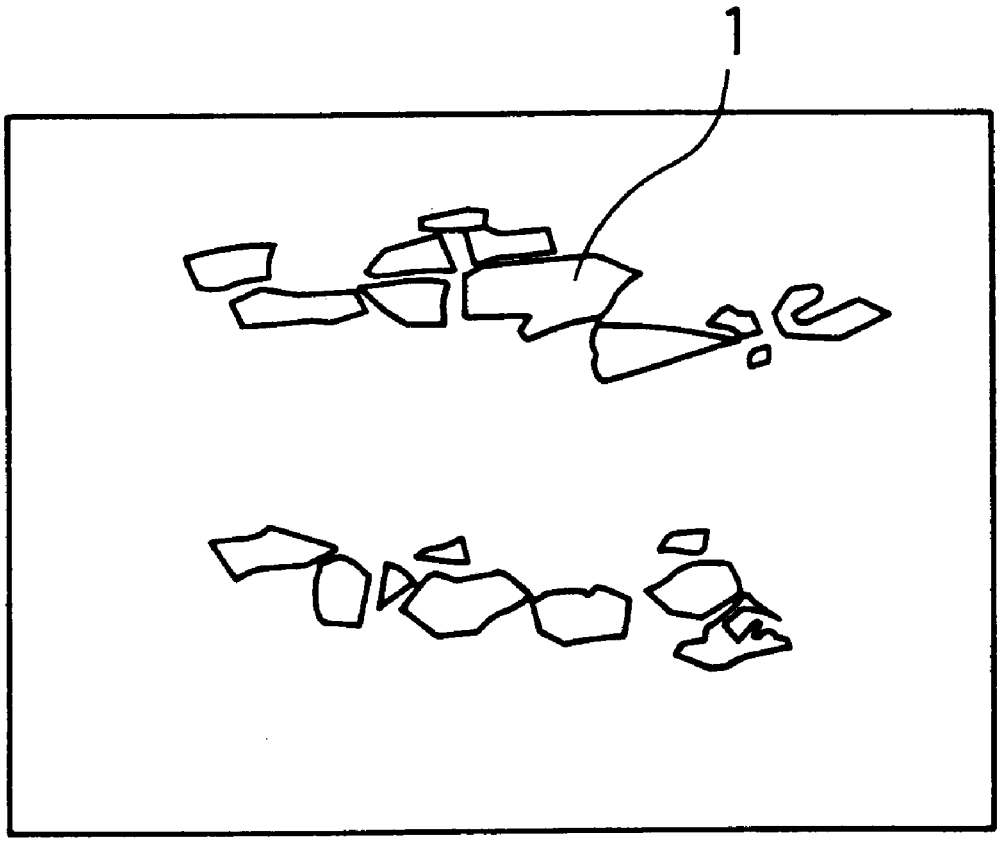
FIG. 4B is a schematic view partly illustrating the photomicrograph of FIG. 4A.

As schematically shown in FIG. 4B a part of the first stage carbide. formed in the composition of the test piece before cold forging shown in FIG. 4A, plenty of the first stage carbide are crystallized in the composition.

Figure 5C:
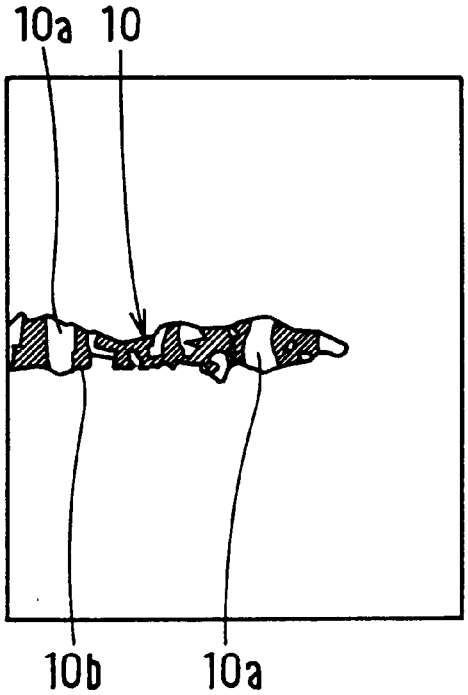
FIG. 5C is a schematic view partly illustrating the photomicrograph of FIG. 5A.
Figure 5D:
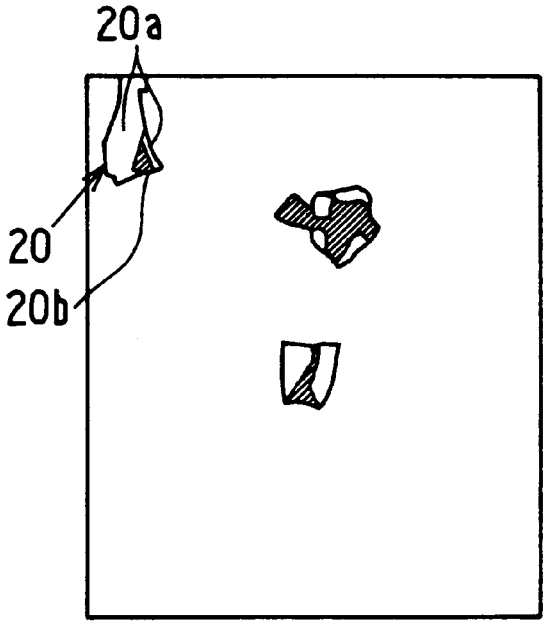
FIG. 5D is a schematic view partly illustrating the photomicrograph of FIG. 5B.

Next, FIGS. 5A and 5B show micro composition of the extruded portions and upset portions, respectively, and FIGS. 5C and 5D show schematically a part of the cracks and voids of first stage carbide shown in FIGS. 5A and 5B.

When the test piece is extruded, first stage carbide 10 shown in FIG. 5C are forced to deform in a horizontal direction of the drawing. But, the deformation can not follow the deformation of base material so that the first stage carbide 10 may be cracked into a plurality of small first stage carbide 10*a*. Therefore, voids 10*b* are formed between the plurality of the first stage carbide 10*a*, as shown in black in the drawing (voids are also shown in black in schematic drawings later described).

Further, when the test piece is upset, first stage carbide 20 shown in FIG. 5D are cracked in a vertical direction of the drawing due to shearing force acting on deformation of the test piece in vertical direction. As a result, the first stage carbide 20 is split out into a plurality of small first stage carbides 20*a* and voids 20*b* are formed between the small first stage carbide 20*a*. Other first stage carbides shown in the drawing are also cracked into small first stage carbides and voids are also formed between the small first stage carbides.

Then, to try to cure the cracks and voids of the first stage carbide, numbers of the test pieces were executed by a commonly used annealing treatment at temperature of 850 to 870° C., which is generally used for dehardening by removing working stress. Then, a state how the cracks and voids are cured was investigated by observing the compositions. The investigation resulted in no distinctive changes, compared with the composition just after the cold forging.

Further, another number of the test pieces was executed by, at first, a spheroidizing treatment at 1050 to 1150° C. by which the carbide deforms in shape so as to be solved to base material and contraction and expansion are given due to transformation at the cooling process, and, then the commonly used annealing treatment mentioned above. After the treatments, the composition was observed, resulting in an incomplete curing state, as shown in FIG. 6A, where grains of the first stage carbide are minimized and rounded a little and the cracks and voids are merely slightly reduced.

Figure 6A:
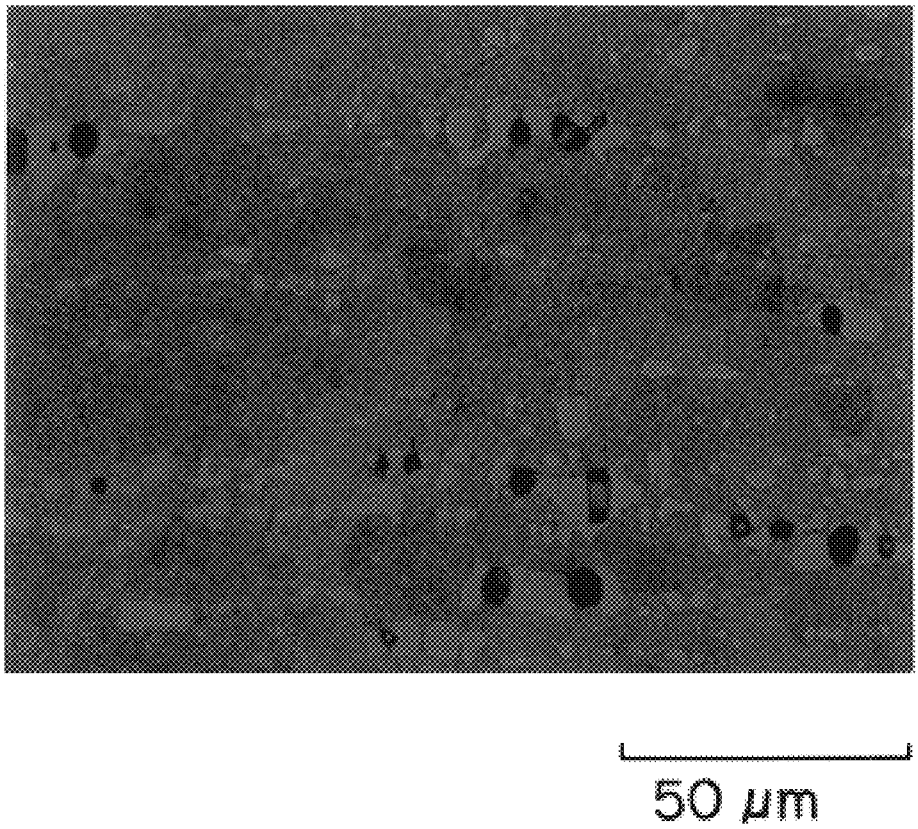
FIG. 6A is a photomicrograph showing a micro internal composition of a component extruded by cold forging and processed by spheroidizing treatment and general annealing.
Figure 6B:
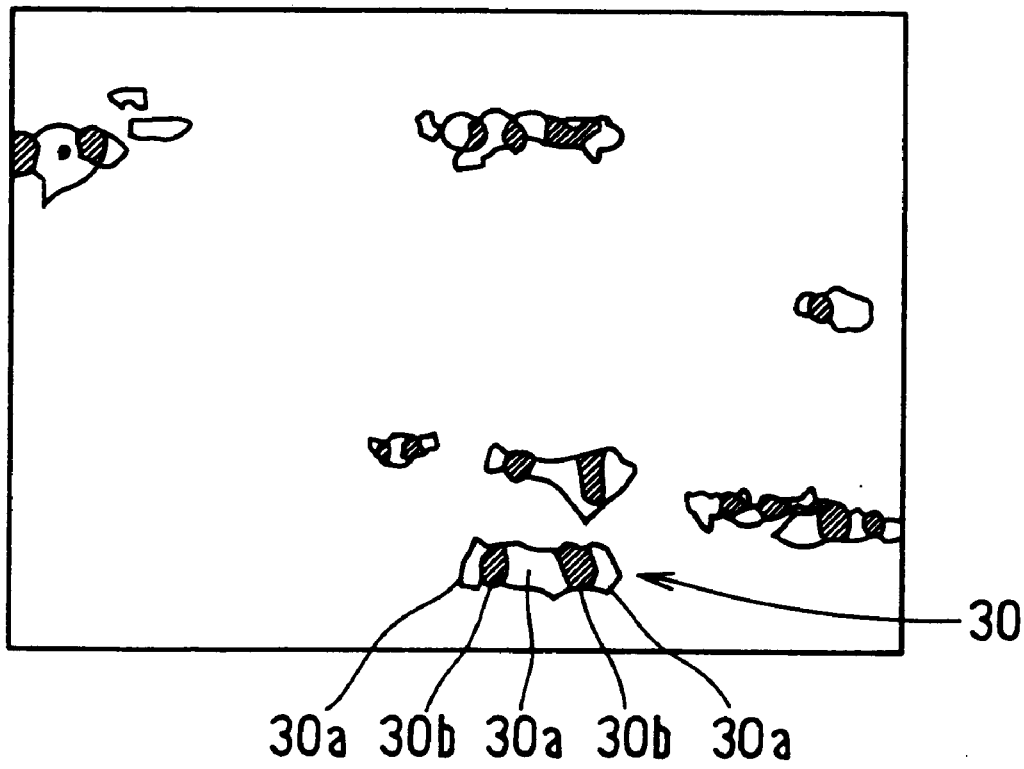
FIG. 6B is a schematic view partly illustrating the photomicrograph of FIG. 6A.

As schematically shown in FIG. 6B with respect to a part of the cracks and voids shown in FIG. 6A, voids 30*b* still remain between small first stage carbide 30*a* into which the first stage carbide 30 are split, even after finishing the treatments mentioned above.

Moreover, further numbers of the test pieces were executed by a HIP treatment in argon gas as pressure intermediate gas, at 1100° C. atmospheric temperature in furnace, with 117.6 Mpa (1200 kgf/cm$^2$) applied pressure and during 3 hours. Then, the internal compositions of the test pieces extruded by cold forging were observed.

Figure 7A:
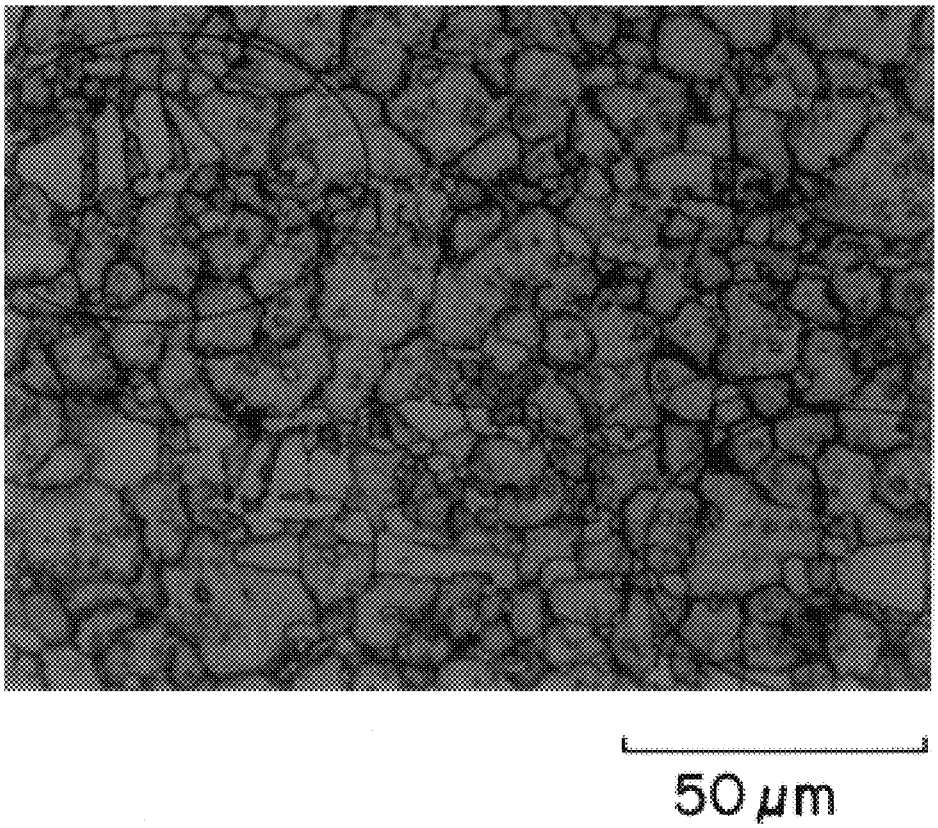
FIG. 7A is a photomicrograph showing a micro internal composition of a component extruded by cold forging and processed by HIP treatment.
Figure 7B:
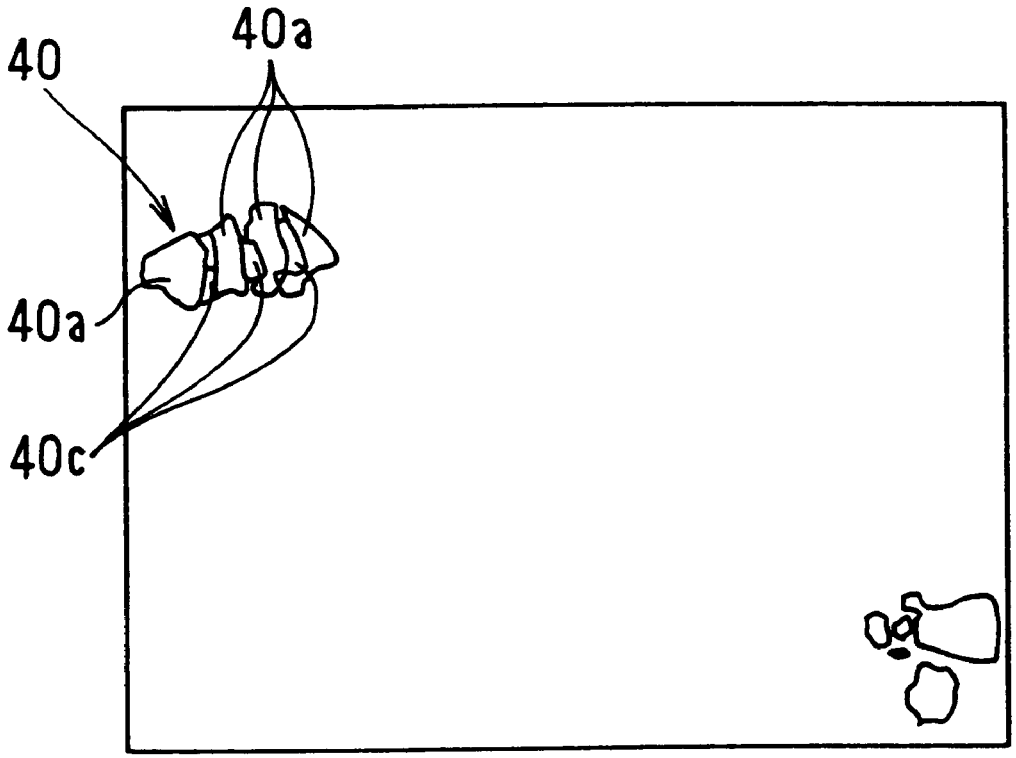
FIG. 7B is a schematic view partly illustrating the photomicrograph of FIG. 7A.
Figure 8A:
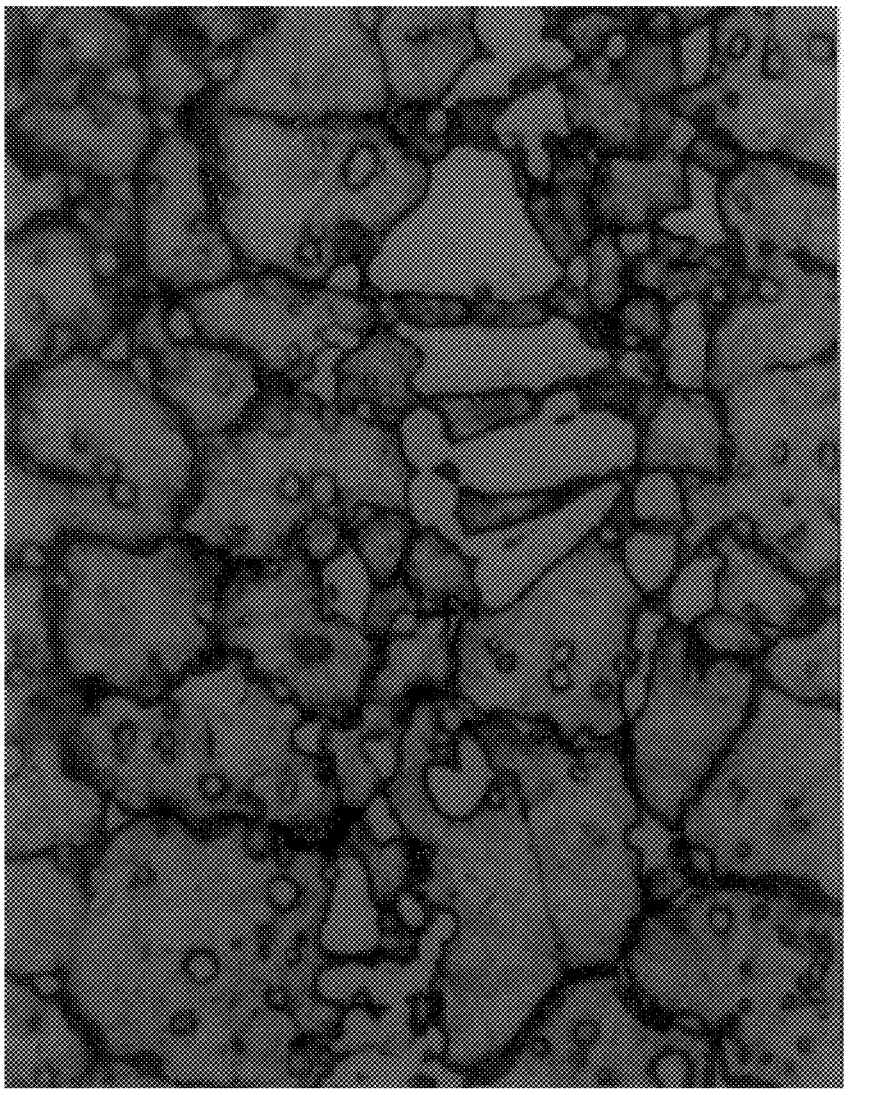
FIG. 8A is a partly enlarged photomicrograph of FIG. 7A.
Figure 8B:
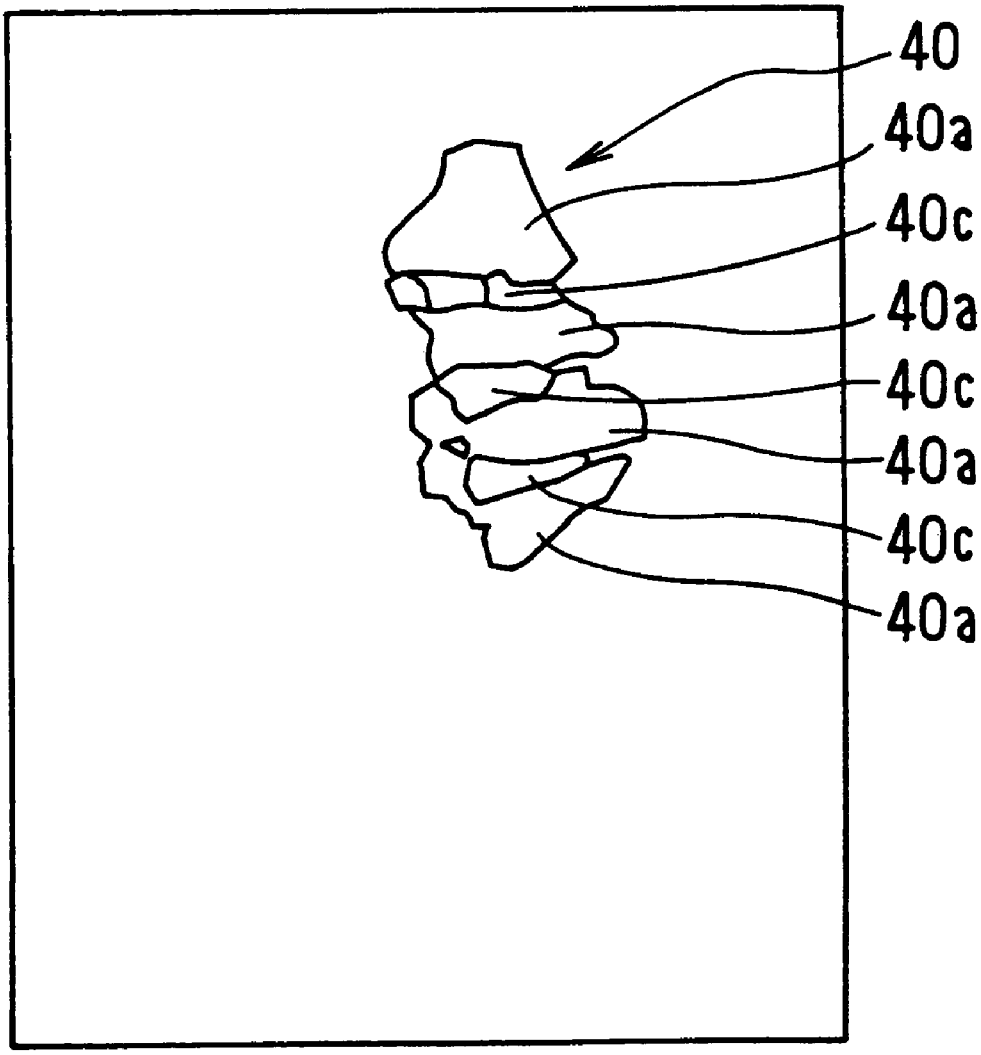
FIG. 8B is a schematic view partly illustrating the photomicrograph of FIG. 8A.

As a result of the observation, as shown in FIGS. 7A and 8A, the voids formed by the cracks of the first stage carbide are filed up with base material and the roundness of the grains improves so that the cracks and voids are effectively cured. As schematically shown in FIGS. 7B and 8B illustrating a part of the cracks and voids shown in FIGS. 7A and 8A, the voids 40*a* between the small first stage carbide 40*a* formed by the cracks of the first stage carbide 40 are completely filled up with base material 40*c*.

Furthermore, evaluation tests were made on machinery characteristics of (A) hot rolling material, (B) material in which the hot rolling material is processed by about 50% cold forging(hereinafter called as "cold forging material") and (c) material in which the cold forging material is further processed by the HIP treatment(hereinafter called as "HIP treatment material"). Test pieces for Charpy impact test, each of which is a 10 mm square×55 m length JIS test piece provided with a 10 R×2 t notch, were formed, respectively, by (A) hot rolling material without any further treatment, (B) cold forging material treated further by annealing for dehardening at 830° C. temperature and (c) HIP treatment material treated also by annealing for dehardening at 830° C. temperature.

Then, after the test pieces were further processed by hardening at 1030° C. temperature in a vacuum heat treatment furnace and by a sub-zero treatment at −100° C. temperature, the test pieces classified into three kinds as to each of (A), (B) and (C) material were prepared by tempering at 200° C., 300° C. and 500° C. temperatures, respectively, and respective machinery characteristics such as impact toughness were investigated.

Figure 3:
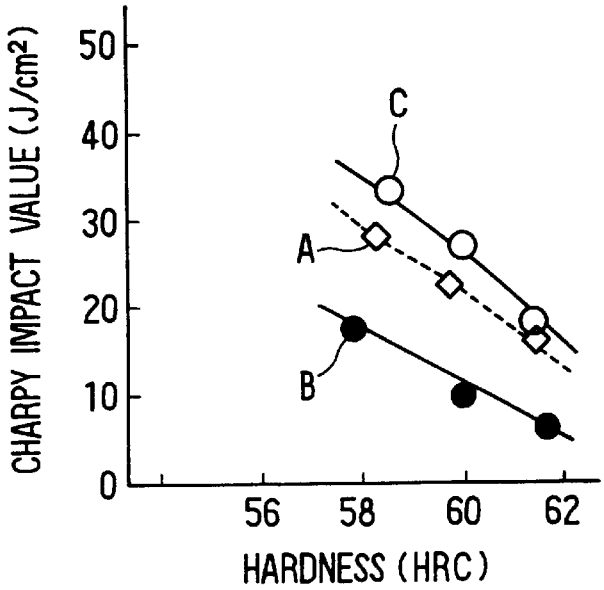
FIG. 3 is a graph showing comparisons of mechanical characteristics (hardness and impact strength) among components made of mere hot rolling material, cold forging processed material and HIP treatment processed material.

FIG. 3 shows test results regarding respective impact strengths of material. The impact strength value of (B) cold forging material is remarkably lower than that of (A) hot rolling material. The reason is due to the cracks of carbide and the voids formed by the split out carbide, as mentioned above.

On the other hand, the impact strength value of (C) HIP treatment material is higher than that of (A) hot rolling material, since the voids are filled up with base material by the HIP treatment at high temperature and with high pressure and the grains of carbide become more fine.

Therefore, it may be concluded that the test results mentioned above suggest a new manufacturing method of steel material by means of plastic deformation working in which grains of carbide are changed to become more fine. In another words, when hot rolling processed steel is further processed positively by cold-warm forging in a manner that the first stage carbide are split out into more fine grain carbide, the steel having better machinery characteristics such as impact strength become available.

Table 3 shows test results of seizure resistance characteristics with respect to three kinds of above mentioned material (A), (B) and (c). Cold forging material (B) shows the worst seizure resistance value, lowest maximum load, among the three kinds of material (A), (B) and (C). This is because that the carbide are likely to come off due to the cracks and voids and it may be difficult to have higher hardness in material (B). On the other hand, HIP treatment material shows an excellent value of the maximum load, which has been never experienced before, because of more fine grain carbide and better impact strength thereof.

TABLE 3

| | Heat treatment condition | | | Seizure |
|---|---|---|---|---|
| Test material | hardening | tempering | Hardness (HRC) | maximum load (kN) |
| SKD 11 (hot rolling material) | 1030° C. AC | 200° C. AC | 61.5 | 5.77 |
| SKD 11 (cold forging material) | 1030° C. AC | 200° C. AC | 61.5 | 4.80 |
| SKD 11 (HIP treatment material) | 1030° C. AC | 200° C. AC | 61.0 | 6.39 |

According to the present invention, the cracks and voids of first stage carbide to be inevitably formed by cold-warm working of high carbon-high alloy group steel may be effectively cured. As a result, highly rigid components having higher air tightness and better wear resistance in use of sliding portions may be manufactured with higher productivity and at lower cost.

What is claimed is:

1. A method of manufacturing a product of high carbon-high alloy steel, comprising the steps of:

executing cold-warm working at a temperature of less than 800° C. to make more than 10% plastic deformation with respect to a hot rolling component made of the high carbon-high alloy steel, which has a plurality of crystallized first stage carbide, so that the crystallized first stage carbide is broken into more fine grain size pieces among which cracks and voids are formed, thereby forming an interim component whose mechanical characteristics including impact strength and seizure resistance are inferior to those, of the hot rolling component; and, then, executing a Hot Isostatic Pressing treatment on the interim component so that the cracks and voids formed by the cold-warm working among the more fine grain size pieces of the first stage carbide are filled with a substrate of the interim component, thereby forming the product the mechanical characteristics of which are superior to those of the hot rolling component.

2. A cold-warm working and heat treatment method of high carbon-high alloy steel according to claim 1, wherein the high carbon-high alloy steel is one of high carbon stainless steel containing more than 0.5 mass % carbon and more than 8 mass % chromium, and tool steel containing more than 0.5 mass % carbon and more than 0.5 mass % at least one of carbine producing metal elements consisting of chromium, molybdenum, tungsten, vanadium, niobium and titanium.

3. A cold-warm working and heat treatment method of high carbon-high alloy steel according to claim 2, wherein .the Hot Isostatic Pressing treatment is executed at a temperature of more than 900° C., with a pressure of more than 88.2 Mpa and during more than 0.5 soaking hours in an inert gas.

* * * * *